US007946663B2

(12) United States Patent
Holcomb

(10) Patent No.: US 7,946,663 B2
(45) Date of Patent: May 24, 2011

(54) DRAWER LOCK MECHANISM

(75) Inventor: Gregory Jon Holcomb, Cedar Falls, IA (US)

(73) Assignee: Waterloo Industries, Inc., Oak Creek, WI (US)

( * ) Notice: Subject to any disclaimer, the term of this patent is extended or adjusted under 35 U.S.C. 154(b) by 754 days.

(21) Appl. No.: 11/745,585

(22) Filed: May 8, 2007

(65) Prior Publication Data

US 2008/0278043 A1 Nov. 13, 2008

(51) Int. Cl.
*E05B 65/46* (2006.01)

(52) U.S. Cl. ..... 312/218; 312/217

(58) Field of Classification Search ..... 312/257.1, 312/215, 216, 217, 218, 220, 221, 222, 17.5, 312/219, 107.5, 194; 70/78, 85; 292/DIG. 18
See application file for complete search history.

(56) References Cited

U.S. PATENT DOCUMENTS

| | | | | |
|---|---|---|---|---|
| 106,970 | A * | 8/1870 | Titus | 312/220 |
| 505,799 | A * | 9/1893 | Brown | 312/220 |
| 700,721 | A | 5/1902 | Ames | |
| 1,231,291 | A | 6/1917 | Otte | |
| 1,247,712 | A | 11/1917 | Ohnstrand | |
| 1,477,278 | A | 12/1923 | O'Connor | |
| 1,569,158 | A | 1/1926 | Tobey | |
| 1,847,106 | A * | 3/1932 | Turner | 312/194 |
| 1,958,686 | A | 5/1934 | Vanderhoof | |
| 2,277,703 | A | 3/1942 | Kennedy et al. | |
| 2,295,697 | A | 9/1942 | Sulentic | |
| 2,528,910 | A | 11/1950 | Poe | |
| 2,719,770 | A | 10/1955 | Roberts | |
| 2,815,252 | A | 12/1957 | Baker | |
| 2,835,547 | A * | 5/1958 | Erismann | 312/219 |
| 2,857,233 | A | 10/1958 | Hahn et al. | |
| 2,859,070 | A | 11/1958 | Gomersall | |
| 3,033,638 | A | 5/1962 | Tomlinson | |
| 3,092,429 | A | 6/1963 | Barnes | |
| 3,123,419 | A | 3/1964 | Maxwell | |
| 3,124,402 | A | 3/1964 | Rhoads | |
| 3,320,003 | A | 5/1967 | Edelson et al. | |
| 3,371,974 | A * | 3/1968 | Vermeersch | 312/218 |

(Continued)

FOREIGN PATENT DOCUMENTS

CA 2 437 147 2/2005

OTHER PUBLICATIONS

International Search Report and Written Opinion from International Application No. PCT/US2008/062767, mailed Aug. 27, 2008.

(Continued)

*Primary Examiner* — James O Hansen
(74) *Attorney, Agent, or Firm* — Calfee, Halter & Griswold LLP

(57) ABSTRACT

A drawer storage container having a plurality of lockable drawers includes a movable lock bar with a drawer catch associated with each of the lockable drawers. The lock bar is moved between an unlocked position and a locked position with an actuator that is coupled to a locking mechanism, such as for example, a key cylinder. Each drawer includes a striker mechanism that is configured to be held by the drawer catch when the lock bar is in the locked position. The actuator includes a release that allows the lock bar to be moved by the striker from the locked to the unlocked position when the striker impacts a camming surface on the catch.

11 Claims, 4 Drawing Sheets

U.S. PATENT DOCUMENTS 3,572,874 A 3/1971 Hassel
3,624,703 A 11/1971 Pavek
3,649,090 A 3/1972 Dutot
3,679,274 A 7/1972 Nance
3,743,366 A 7/1973 Tazaki
3,874,755 A 4/1975 Hegg et al.
4,057,306 A * 11/1977 Resch, Jr. ..... 312/218
4,065,196 A 12/1977 Stein
4,072,375 A 2/1978 Boone
4,090,753 A 5/1978 Rock et al.
4,191,436 A 3/1980 Cherry
4,210,303 A 7/1980 Torta et al.
4,384,746 A 5/1983 Ferdinand et al.
4,440,461 A 4/1984 Powell et al.
4,480,883 A 11/1984 Young
4,516,811 A 5/1985 Akiyama et al.
4,681,381 A 7/1987 Sevey
4,721,347 A * 1/1988 Kritselis ..... 312/219
4,861,123 A 8/1989 Russell
5,257,860 A * 11/1993 Slivon ..... 312/218
5,433,517 A 7/1995 Fleisch
5,575,564 A 11/1996 Harmon et al.
5,685,622 A 11/1997 Laakso
5,862,689 A 1/1999 Wen
5,890,811 A 4/1999 Bryson
5,927,839 A 7/1999 Alfaro
5,951,132 A 9/1999 Cirocco
6,076,908 A 6/2000 Maffeo
6,347,848 B1 2/2002 Cho
6,409,290 B1 6/2002 Lin
6,572,203 B1 6/2003 Cheng
6,626,509 B2 9/2003 Remmers
6,719,380 B1 4/2004 Liu
6,722,749 B1 4/2004 Pagac
6,896,342 B1 * 5/2005 Cheng ..... 312/221
7,048,347 B1 5/2006 Liu
7,144,092 B1 * 12/2006 Chang ..... 312/217
2006/0066190 A1 3/2006 Hay
2006/0132005 A1 6/2006 Cheng
2006/0181182 A1 8/2006 Hung
2008/0278043 A1 11/2008 Holcomb

OTHER PUBLICATIONS

Office Action from U.S. Appl. No. 11/745,569 mailed Jan. 19, 2010.

* cited by examiner

DRAWER LOCK MECHANISM

FIELD OF THE INVENTION

The invention pertains generally to the field of lockable drawer storage containers.

BACKGROUND

Lockable drawer containers, such as filing cabinets and tool chests and cabinets, feature a variety of locking mechanisms and features. Many lockable chests include a keyed lock cylinder that actuates a locking mechanism that locks the drawers in a closed position. Once the chest is locked, it is difficult or impossible to close and secure a drawer that was open at the time the locking mechanism was actuated. If a drawer is inadvertently or otherwise left open during locking, it is thus necessary for a proper key to be used to unlock the chest, close the drawer, and re-lock the chest.

SUMMARY

A drawer lock for use with a lockable drawer chest includes a striker attached to a rear portion of a drawer that is selectively retained by a catch on a vertical lock bar. The lock bar is moved between a locked and unlocked position with an actuator that acts in response to motion of a chest locking mechanism. The catch includes a camming surface that urges the lock bar from the unlocked position when the striker plate impacts the camming surface as the drawer is closed. The actuator includes a relief that allows the lock bar to be moved by the striker from the locked position to the unlocked position. In this manner, a drawer that was open at the time the chest was locked can be closed and secured without the necessity of unlocking the chest.

Further features and advantages of the invention will become apparent from the following detailed description made with reference to the accompanying drawings.

BRIEF DESCRIPTION OF THE DRAWINGS

In the accompanying drawings, which are incorporated in and constitute a part of this specification, embodiments of the invention are illustrated, which, together with the description of the invention serve to illustrate the principles of this invention. The drawings and detailed description are not intended to and do not limit the scope of the invention or any subsequent claims in any way. Instead, the drawings and description only describe embodiments of the invention and other embodiments of the invention not described are encompassed by this disclosure of the invention.

DESCRIPTION OF THE INVENTION

The Detailed Description of the Invention merely describes preferred embodiments of the invention and is not intended to limit the scope of the specification or claims in any way. Indeed, the invention as described by the claims is broader than and unlimited by the preferred embodiments, and the terms in the claims have their full ordinary meaning.

Figure 1:
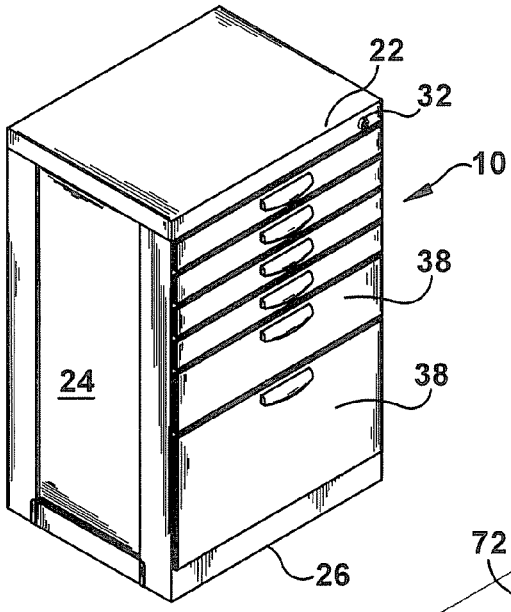
FIG. 1 is a perspective view of a lockable drawer chest.

FIG. 1 is a perspective view of a tool chest 10. A tool chest is illustrated for exemplary purposes only. It should be apparent to one with ordinary skill in the art that the invention can be practiced with any suitable storage container having one or more drawers, such as for example, a tool chest, a tool cabinet, or a filing cabinet. The chest 10 includes a top wall 22, side walls 24, bottom wall 26, and a rear wall 28 (shown in FIG. 2). The walls define a cavity in which drawers 38 are slideably mounted. The chest is lockable, such that the drawers can be locked in the closed position. In the embodiment shown in FIGS. 1 and 2, the chest includes a key cylinder 32 that is rotatable upon insertion of a proper key. Other locking mechanisms are also known and can be used in practice of the present invention. Alternative locking mechanisms include, but are not limited to, combination locks or motorized lock actuators that can be controlled by wireless remote control signals.

Figure 2:
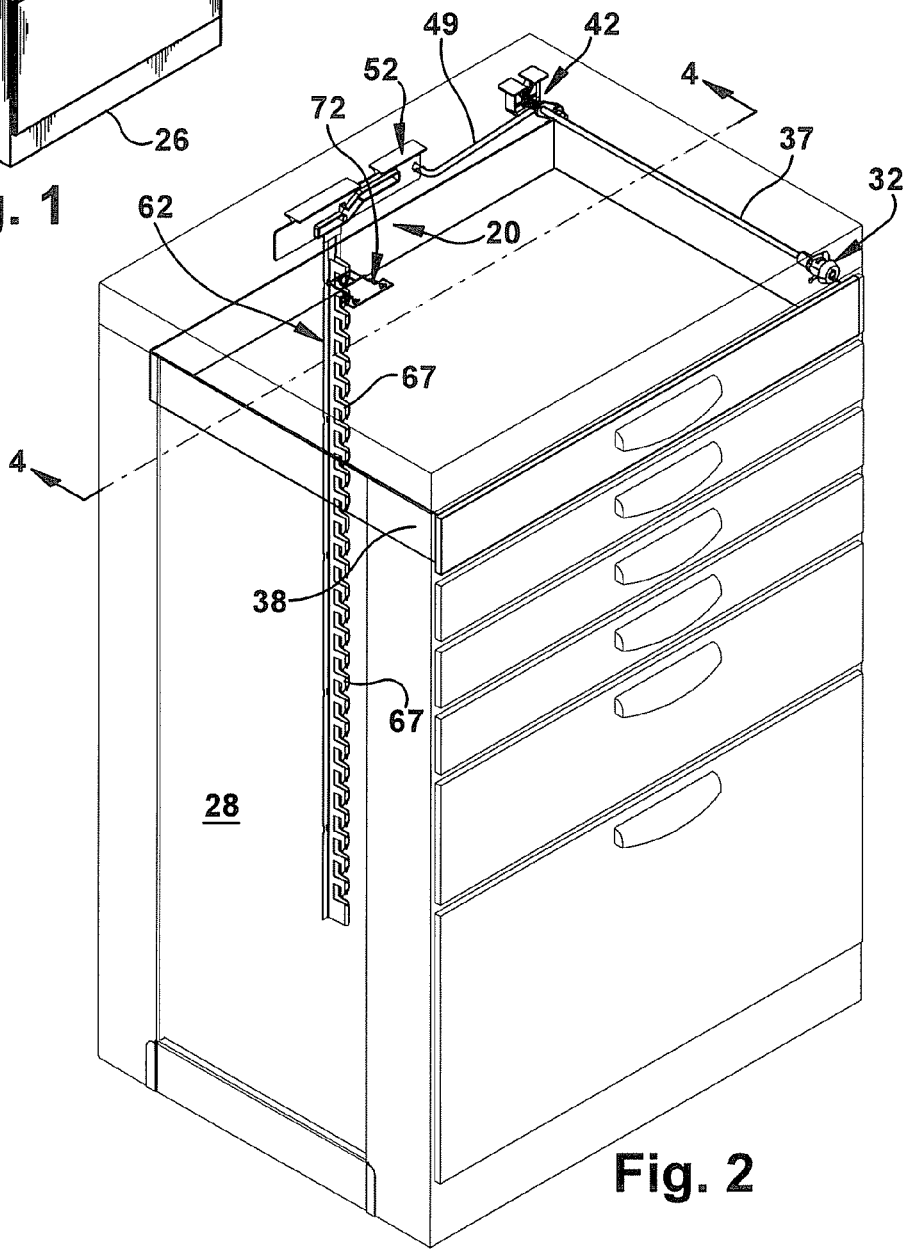
FIG. 2 is a perspective view of the lockable drawer chest with outer walls in phantom to reveal a drawer lock mechanism constructed in accordance with one embodiment of the present invention.

FIG. 2 is a perspective view of the chest 10 of FIG. 1 with the walls and drawers in phantom to reveal a drawer lock mechanism 20. The drawer lock mechanism 20 includes a lock bar 62 and an actuator 52 located in the chest and a striker plate 72 connected to each locking drawer. As will be described in more detail below, the lock bar 62 is moved between a locked position and an unlocked position by the actuator when the key cylinder 32 is rotated. When the lock bar is moved downward to the locked position, a catch 67 on the lock bar is aligned with the striker plate 72 to hold the drawer in the closed position. When the lock bar is moved upward to the unlocked position, the catch is not aligned with the striker plate and the drawer can be opened. If the lock bar is in the locked position while a drawer is open, the striker plate 72 lifts the catch 67 when the drawer impacts the catch so that the drawer may be closed and locked without the use of the key cylinder to unlock the chest.

Figure 3:
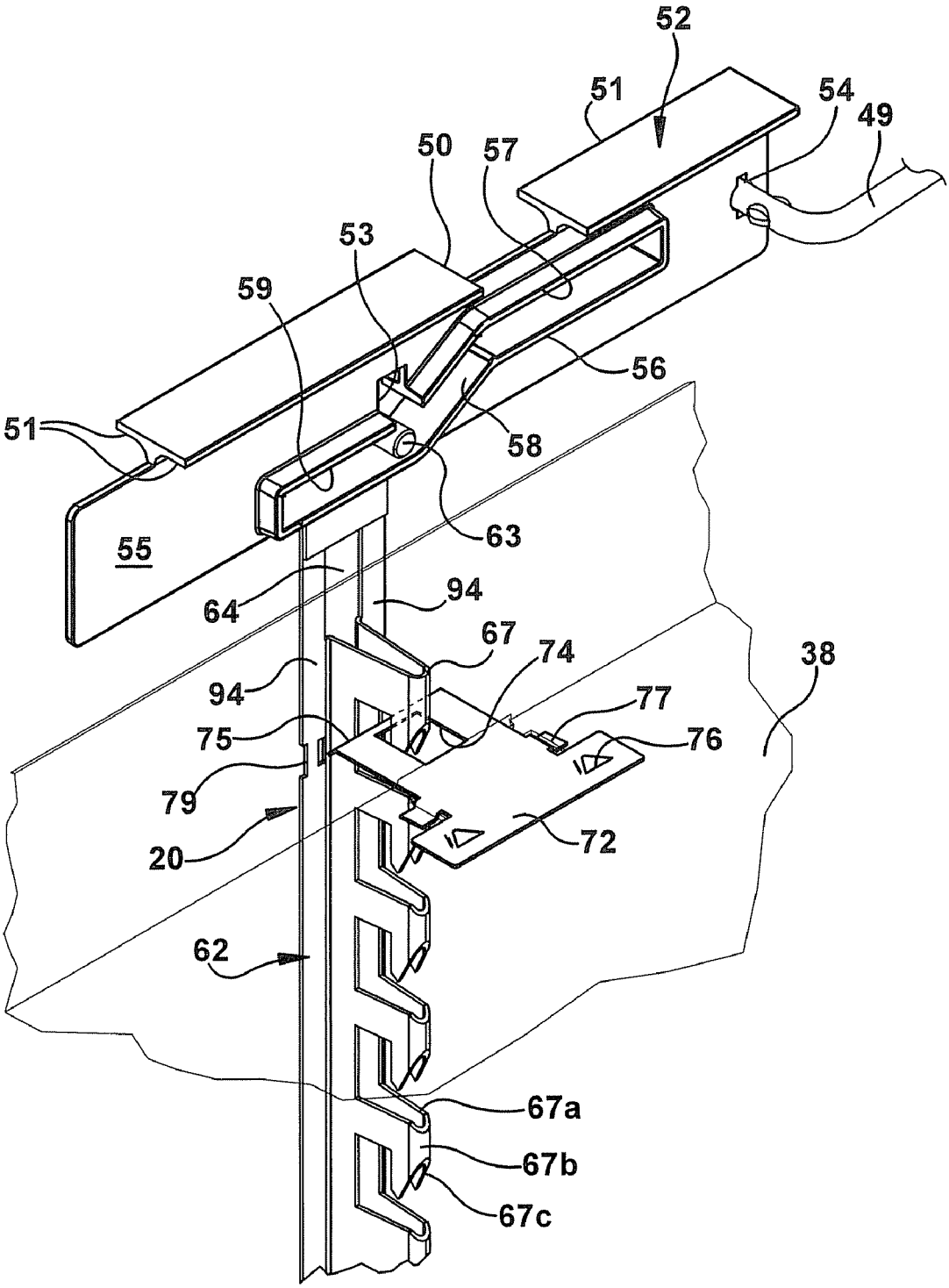
FIG. 3 is an enlarged fragmentary view of the drawer lock mechanism of FIG. 2.

FIG. 3 illustrates the drawer lock mechanism 20 in greater detail. The lock bar 62 is made of a formed metal strip 64 and includes a lock bar guide pin 63 that protrudes orthogonally from the top of the lock bar 62 and is retained in a slot 56 in the actuator 52. A plurality of catches 67 are formed in the metal strip 64. Each catch 67 includes a generally L-shaped finger with a first leg 67*a* and an orthogonal second leg 67*b*. The second leg 67*b* has a taper 67*c* on a front face that confronts the striker plate when the drawer is closed. The lock bar 62 is slideably retained in a lock bar channel 94 (FIG. 5) on the rear wall 28 of the chest. The lock bar channel is formed from a pair of spaced rolled flanges that loosely enclose the side edges of the metal strip 64. In some embodiments, the edges of the metal strip 64 include one or more notches 79. Friction reducing inserts 81 (FIG. 4) are pressed into the notches 79. The friction reducing inserts are thicker than the metal strip 64 and therefore the lock bar rides on the friction reducing inserts 81 as it is moved within the lock bar channel 94. The friction reducing inserts may be made from nylon or other suitable material.

The striker plate 72 is stamped from metal and has a general T-shape. The striker plate 72 is connected at one end to the drawer with punched out lances 76. A pair of bent legs 77 engage the drawer to properly position the striker plate with respect to the drawer. The striker plate includes a lock opening 74 at a leading end. The leading end includes a declined edge 75 that is angled to co-act with the taper 67*c* on the catch 67 to lift the catch when the drawer is closed against the catch.

The actuator 52 is molded from a suitable plastic material and includes a vertically oriented plate portion 55 into which the slot 56 is cut and a perpendicular mounting plate portion 51 that fits into an actuator channel formed by a series of actuator channel tabs 23 (FIGS. 4-6) that are folded over to slideably retain the mounting plate portion 51. The mounting plate includes a notch 50 that provides clearance for installation of the mounting plate portion 51 between the channel tabs 23 into the actuator channel. A link 49 is pressed into a receiving hole 54 at one end of the plate portion 55.

The actuator 52 converts linear motion of the link 49 to vertical motion of the lock bar guide pin 63. To achieve this motion conversion, the actuator includes the slot 56 which includes a top horizontal slot portion 57 and a bottom horizontal slot portion 59 connected by a slanted camming slot portion 58 that transitions between the top and bottom horizontal slot portion. The top horizontal slot portion 57 positions the guide pin in an up position to place the lock bar in the unlocked position. The bottom horizontal slot portion 59 positions the guide pin in a down position to place the lock bar in the locked position. A vertical relief slot portion 53 intersects the bottom horizontal slot portion to provide a path for the guide pin to travel when the lock bar is lifted by striker plate 72 impacting a catch 67 when a drawer is closed in an already locked chest.

Figure 4:
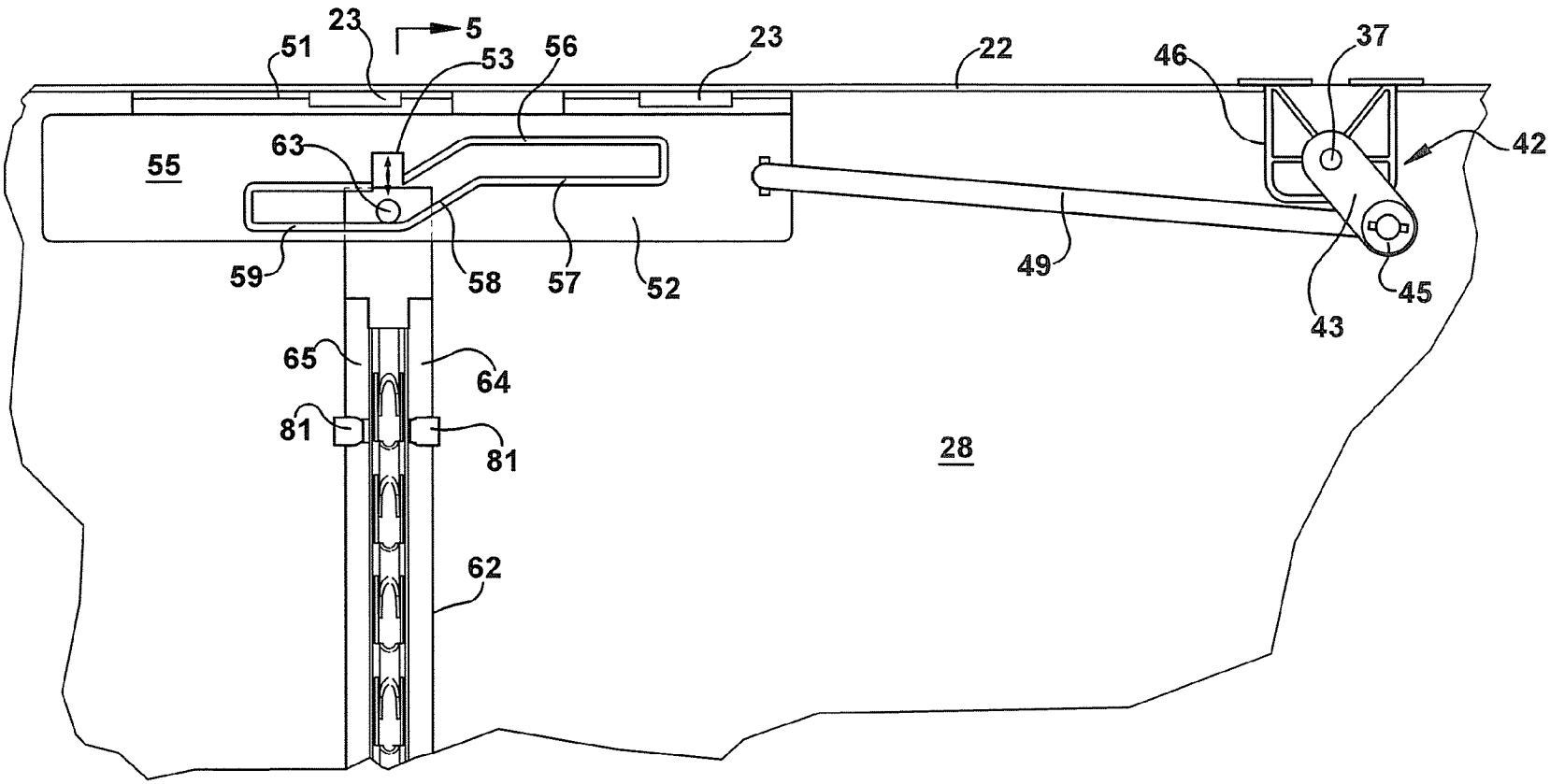
FIG. 4 is a front view of a portion of the drawer lock mechanism of FIG. 2.

Referring now to FIG. 4, the linkage 42 that couples the actuator 42 to the key cylinder (shown in FIG. 2) is illustrated. The linkage includes a short link 42 that is rigidly connected to a key cylinder rod 37 such that rotation of the key cylinder is transmitted via the rod to the short link. As can be seen best in FIGS. 5-7, the key cylinder rod 37 passes through the short link 43 and is pivotally retained in a pivot bracket 46 that is suspended from the top wall 22. A spring 96 urges the short link 43 into proper alignment with the bracket 46 and actuator 52. The link 49 is pressed into a distal end of the short link and is retained by a washer 45 that allows the link 49 to rotate within the short link 43. In this manner, the linkage 42 allows the link 49 to move the actuator side to side in response to rotation of the key cylinder 32.

Movement of the key cylinder to lock the chest causes corresponding movement of the actuator 52 to the right and the guide pin 63 slides down the slanted camming slot portion 58 and into the lower horizontal slot portion 59 to rest in the position shown in FIG. 4. The vertical relief slot portion 53 is positioned above the guide pin so that there is clearance for the lock pin to move if the lock bar is lifted by the catch 67 impacting the striker plate 72 (FIG. 3). Movement of the key cylinder to unlock the chest causes corresponding movement of the actuator 52 to the left and the guide pin 63 slides up the slanted camming slot portion 58 and into the upper horizontal slot portion 57. When the lock bar 62 is in this position, the catch 67 is positioned away from the opening 74 in the striker plate 72 and the drawer can be opened freely.

Figure 7:
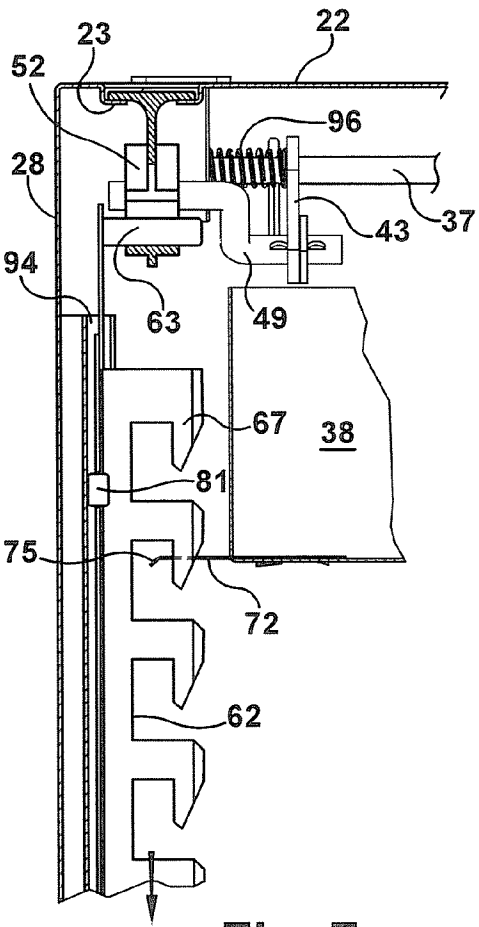
FIGS. 5-7 are side views of the drawer lock mechanism of FIG. 2 in various operating positions.
Figure 6:
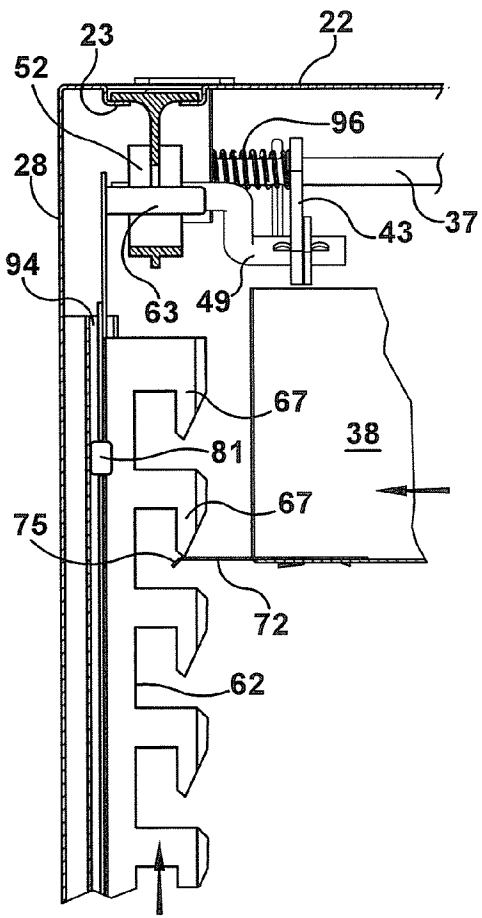
Figure 5:
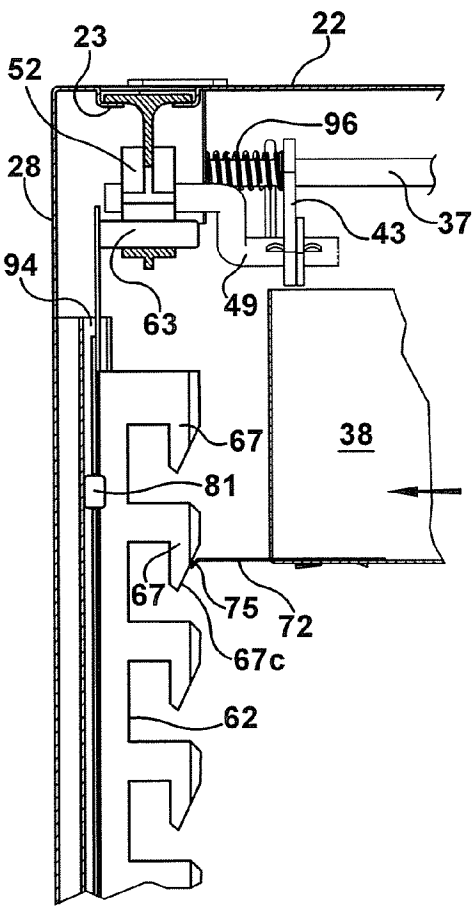

FIGS. 5-7 illustrate the closing of a drawer 32 when the chest is locked. The key cylinder 32 (FIG. 2) has been turned to lock the chest and the actuator 52 has been positioned to the left within the chest. The guide pin 63 rests in the lower horizontal slot portion 59 below the vertical relief slot portion 53. In FIG. 5, the catch 67 is positioned so that the taper 67*c* confronts the declined edge 75 of the striker plate. The lock bar is thus lifted by the striker plate 72 and the guide pin 63 moves up into the vertical relief slot portion 53. Referring to FIG. 6, as the drawer continues to move toward the rear of the tool chest 10 to the closed position the striker plate 72 lifts the lock bar 62 and the catch 67 rides along the striker plate. Once the drawer has traveled to the closed position, the catch 67 falls into the opening 74 as shown in FIG. 7. The drawer 32 is now locked in position.

While various aspects of the invention are described and illustrated herein as embodied in combination in the exemplary embodiments, these various aspects may be realized in many alternative embodiments not shown, either individually or in various combinations and sub-combinations thereof. Unless expressly excluded herein all such combinations and sub-combinations are intended to be within the scope of the present invention. Still further, while various alternative embodiments as to the various aspects and features of the invention, such as alternative materials, structures, configurations, methods, devices, and so on may be described herein, such descriptions are not intended to be a complete or exhaustive list of available alternative embodiments, whether presently known or later developed. Those skilled in the art may readily adapt one or more of the aspects, concepts or features of the invention into additional embodiments within the scope of the present invention even if such embodiments are not expressly disclosed herein. Additionally, even though some features, concepts or aspects of the invention may be described herein as being a preferred arrangement or method, such description is not intended to suggest that such feature is required or necessary unless expressly so stated. Still further, exemplary or representative values and ranges may be included to assist in understanding the present invention however; such values and ranges are not to be construed in a limiting sense and are intended to be critical values or ranges only if so expressly stated.

What is claimed is:

1. A drawer lock for use with a storage container having a top wall, a bottom wall, a pair of spaced side walls and a rear wall that define a drawer cavity in which one or more drawers are housed, the drawers being moveable between an open and a closed position, the drawer lock comprising:

a striker disposed on a rear portion of each drawer, the striker including a retention feature;

a vertical lock bar slideably mounted to the rear wall and moveable between a locked position and an unlocked position, the lock bar including a catch aligned with the striker on a corresponding drawer such that the catch engages and retains the retention feature when the lock bar is in the locked position and the drawer is in the closed position and wherein the catch includes a camming surface that urges the lock bar from the locked position to the unlocked position when the striker impacts the camming surface as the drawer is moved from the open position to the closed position;

a container lock mechanism; and an actuator coupled to the lock bar configured to move the lock bar between the locked and unlocked position in response to movement of the container lock mechanism;

wherein the lock bar includes a guide pin and the actuator comprises a slot in which the guide pin rides and wherein the slot includes an upper horizontal slot portion connected through a camming slot portion to a lower horizontal slot portion, each horizontal slot portion acting upon the guide pin to position the lock bar in one of the locked or unlocked positions;

further wherein the actuator includes a vertical relief slot intersecting the lower horizontal slot portion proximate the camming slot portion, with the lower horizontal slot portion extending horizontally beyond the vertical relief slot and away from the camming slot portion, wherein when the lock bar is in the locked position, the guide pin is biased toward a rest position in the lower horizontal slot portion aligned with the vertical relief slot.

2. The drawer lock of claim 1 wherein the vertical relief slot allows the lock bar to be moved to the unlocked position from the locked position by the striker.

3. The drawer lock of claim 1 comprising a vertical lock bar channel configured to be mounted to the rear wall.

4. The drawer lock of claim 3 wherein the lock bar includes one or more friction reducers that define one or more surfaces upon which the lock bar slides within the lock bar channel.

5. The drawer lock of claim 4 wherein the friction reducers comprise a plastic insert that is fitted into a corresponding notch on a side edge of the lock bar.

6. The drawer lock of claim 5 wherein the plastic insert is made of nylon.

7. The drawer lock of claim 1 wherein the catch comprises a generally L-shaped finger that includes a first leg that projects orthogonally from the rear wall of the storage container and a second leg that projects orthogonally from the first leg toward the bottom of the storage container.

8. The drawer lock of claim 7 wherein the striker comprises a plate and wherein the retention mechanism is an opening through the plate sized to receive the second leg of the L-shaped finger.

9. The drawer lock of claim 7 wherein the camming surface is a taper on a face of the second leg of the L-shaped finger that confronts the striker when the drawer is closed.

10. The drawer lock of claim 7 wherein the striker includes an angled end portion at an end of the plate that contacts the second leg when the drawer is closed, wherein the angle end portion is bent toward the bottom of the storage container to urge the lock bar up to the unlocked position when the striker plate contacts the second leg of the L-shaped finger.

11. The drawer lock of claim 1, wherein the container lock mechanism includes a key cylinder, a first link that is fixedly coupled to the key cylinder for rotation therewith, and a second link pivotally connected to the first link and connected to the actuator, such that keyed rotation of the key cylinder horizontally slides the actuator between the locked and unlocked positions.

* * * * *